United States Patent [19]

Karch et al.

[11] 4,068,201

[45] Jan. 10, 1978

[54] MANUAL STARTER WITH LOW VOLTAGE RELEASE

[75] Inventors: Walter C. Karch, Grafton; Joseph J. Gribble, Milwaukee, both of Wis.

[73] Assignee: Square D Company, Park Ridge, Ill.

[21] Appl. No.: 700,658

[22] Filed: June 28, 1976

[51] Int. Cl.[2] ..... H01H 9/00

[52] U.S. Cl. ..... 335/173; 335/174

[58] Field of Search ..... 335/166, 167, 169, 173, 335/174, 160, 161

[56] References Cited

U.S. PATENT DOCUMENTS

| | | | |
|---|---|---|---|
| 3,315,190 | 4/1967 | Mouis | 335/173 X |
| 3,604,874 | 9/1971 | Puetz | 200/153 G |

*Primary Examiner*—George Harris

*Attorney, Agent, or Firm*—William H. Schmeling; Richard T. Guttman

[57] ABSTRACT

A manually operated snap acting switch having contacts in a circuit connecting an electric source to an electric load. The switch has contacts operated by a toggle mechanism and includes elements and mechanisms for causing the levers of the toggle mechanism to move to a tripped position and the contacts of the switch to open whenever the current in the circuit exceeds a predetermined value or in event of a power failure of the source. The elements and mechanism causing the movement of the levers to the tripped position and an opening of the circuit in event the source has a power failure include a spring-biased lever, a solenoid, which is continuously energized by the source, and a latch which is moved to released position by the solenoid plunger when the solenoid is de-energized. The lever which causes the toggle levers to move to the tripped position is held in an inactive position by the latch and moves to an active position when the solenoid is de-energized and the latch is moved to its released position. The solenoid, latch and spring-biased lever are positioned in a cavity in the base of the switch and the toggle mechanism is arranged so its levers do not move to the tripped position when the toggle levers are in the OFF position and the power of the source fails.

10 Claims, 13 Drawing Figures

MANUAL STARTER WITH LOW VOLTAGE RELEASE

This invention relates to electric switches and more particularly to a manual starter having means for automatically opening the contacts of the switch in event of the power failure.

The manually operated switch according to the present invention is particularly suited for use as a motor starter in installations where an unexpected restarting of the motor after a power failure could cause personnel injury or damage of equipment. Manual starters are well known, and, as illustrated by the starter disclosed in U.S. Pat. No. 3,604,874, which was granted on Sept. 14, 1971. to Jordan F. Puetz on an application filed on Feb. 6, 1970, usually include switching contacts, operated by a toggle mechanism, and a means for causing the switching contacts to open when the motor in the circuit controlled by the starter is subjected to overload current conditions. While the starter as disclosed in the Puetz patent has enjoyed enthusiastic acceptance, it is not suitable for use in motor applications where an unexpected restarting of the motor after a power failure cannot be tolerated. The manually operated switch according to the present invention represents an improvement in the switch disclosed in the Puetz patent and overcomes this deficiency.

Certain portions of the Occupational Safety and Health Act of the United States, as illustrated by Section 1910.213(b) (3) require "On applications where injury to the operator might result if motors were to restart after power failures, provision shall be made to prevent machines from automatically restarting upon restoration of power," preclude the use of the starter disclosed in the Puetz patent in installations required to satisfy the quoted section. Additionally, certain utilities, particularly those utilities serving rural areas, object to manual starters which maintain their contacts closed during power failures. The objections of the utilities is based on the fact that when a large number of motors controlled by non-power failure responsive starters are connected to the source and a power failure occurs, the large number of motors must be simultaneously supplied with starting currents during the period when power is restored. This greatly increases the power requirements on the generators during the start-up period. The starter according to the present invention incorporates a low voltage release feature and thus satisfies the OSHA requirements, overcomes the objections of the utilities and may be wired in the motor circuit in the same manner as starters not having the low voltage feature are wired in the circuit.

The starter according to the present invention includes power loss detecting means that is positioned in a cavity in the rear wall of the base of the starter with the detecting means including a solenoid which is continuously energized through conductors that are concealed through factory wired connections to the line terminals of the starter. Thus when the starter incorporating the power loss detecting means is mounted and wired on a panel it will occupy the same panel area and have the same wired connections as a starter that does not have the detecting means.

The starter according to the present invention includes an additional desirable feature. It is well known that in a large number of factories a plurality of motors are each individually controlled by a motor starter and at the end of a work shift or work week the starters are turned to their OFF states to de-energize their associated motor before a main switch is opened to disconnect all of the motor circuits from the main power source. In the starter according to the present invention, the levers of the toggle mechanism are arranged to prevent the levers from moving to the tripped position when the levers are in the OFF position. Thus when power to the starter is interrupted and re-established while the starter is in the OFF state, it is not necessary to reset the starter before the starter is turned on.

It is an object of the present invention to provide an electric switch with a means which will cause the contacts of the switch to move to circuit opening positions when the switch is subjected to excess currents or loss of power from a voltage source.

Another object is to provide a means in a cavity in the rear wall of the base of a manually operated starter which will cause the starter to trip when the power to the starter is interrupted.

A further object is to incorporate a means in a manually operated motor starter which will detect the loss of power to the starter without increasing the panel area requirements of the starter or increasing the number of wire connections to the starter when the starter incorporating the detecting means is mounted and wired on a panel.

An additional object is to position a solenoid. a spring biased lever and a latch lever in a cavity in a rear wall of a manually operated starter and to connect the solenoid leads to the line terminals of the starter so the solenoid is continuously energized by the source connected to the line terminals and to connect the plunger of the solenoid to the latch so that the latch is maintained in a latching engagement with the lever to prevent the lever from operating a trip mechanism in the starter when the solenoid is energized and to cause the latch to move to a released position and the lever to actuate the trip mechanism when the solenoid is de-energized and the contacts of the starter are in circuit closing positions.

Further objects and features of the invention will be readily apparent to those skilled in the art from the following specification and from the appended drawings illustrating certain preferred embodiments, in which.

Figure 1:
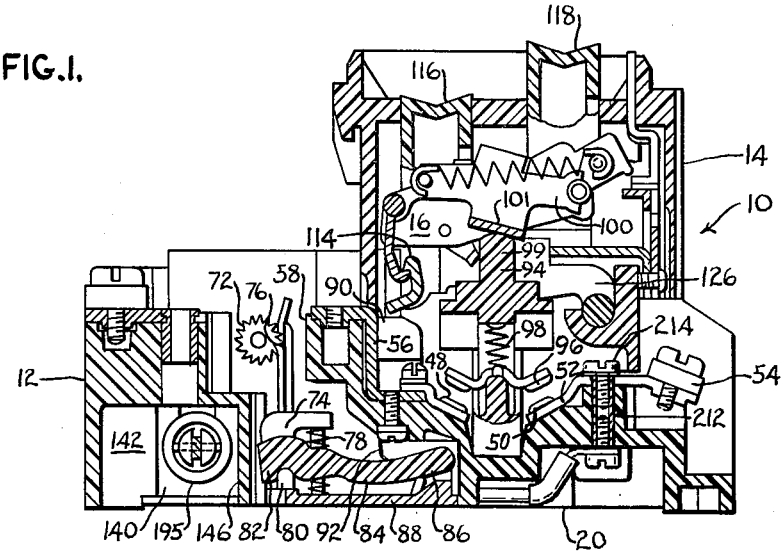
FIG. 1 is a cross-sectional view of a manually operated electric switch incorporating the features of the present invention.

As the manually operated electric switch 10 as shown in the drawings represents an improved form of the switch disclosed and claimed in the Puetz patent, supra, only those portions of the switch operating to aid in the understanding of the present invention will be described. For those portions not described in detail herein, reference is directed to the Puetz patent. The switch 10 includes an insulating base 12 and a housing 14, which is detachably secured to a front surface of the base 12. The housing 14 encloses a toggle acting type operating mechanism 16 for the switch 10 and is secured to a front of the base by suitable screws, not shown, which are threaded into inserts 18 that are embedded in the base 12, shown in FIG. 2.

The base 12 is formed of a suitable molded material, preferably having arc suppressing characteristics, to have a rear wall 20 which may be secured to a vertical panel, not shown, when the switch 10 is placed in service. The securement of the base 12 on the panel is facilitated by suitable openings 22 which receive suitable screws and the like. While the base 12 is formed as a unitary member, it may be considered as having a portion 24 providing a switching function on one end and a portion 26 providing a current overload and a loss of voltage detecting portions at its other end. The base 12 has a pair of side walls 28 and 30 extending substantially over its entire length. Extending forwardly of the rear wall 20 at the switching end 26 are four spaced partitions 32, 33, 34 and 35 which define a row of side by side arc chambers 36, 38 and 40 and a compartment 42 located between the side wall 28 and the partition 32 at one side of the base 12 and a compartment 44 that is located between the side wall 30 and the partition 35 on the other side of the base 12. Positioned in each of the arc chambers 36, 38 and 40 is a pair of stationary contacts which are mounted in spaced relation to each other on opposite sides of a center line 46, shown in FIG. 2. The contacts of each pair of stationary contacts are respectively designated by numerals 48 and 50. The stationary contacts 50 are supported within the chambers 36, 38 and 40 by one end of terminal members 52. The terminal members 52 act as line terminals for the switch 10 and extend to the top end of the base to provide a support for wire clamping members 54. The contacts 48 in turn are supported by conductive strap-like members 56 having ends resting on abutments 58 formed on the base 12 at the upper end of the overload detecting portion 26. Each of the partitions 32-35 has a slot extending from a front edge of the base toward the rear wall 20. The slots in the partitions 35 and 36 have edges which serve to guide the travel of a carrier for the movable contacts, as will be later described.

Figure 2:
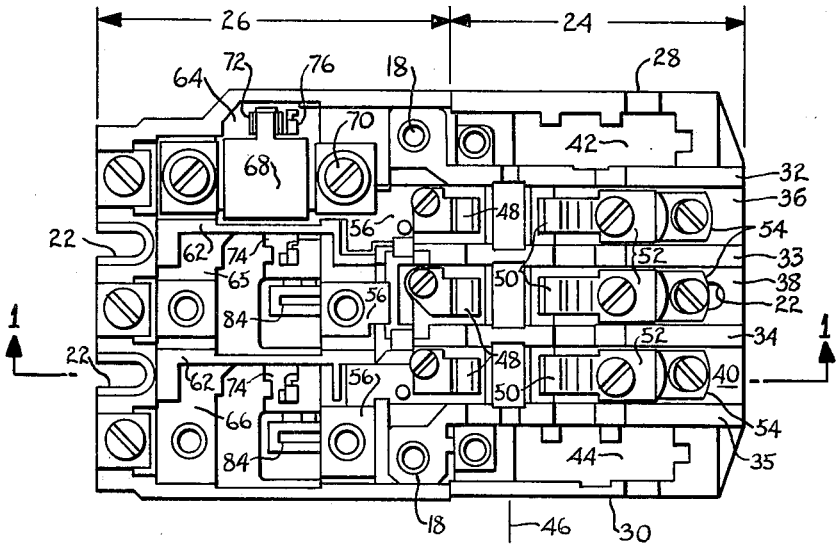
FIG. 2 is a front plan view of the base portion of the switch in FIG. 1 with the housing containing the operating mechanism and certain overload heater elements for the switch in FIG. 1 removed and showing a line 1–1 along which the cross-section in FIG. 1 is taken.
Figure 3:
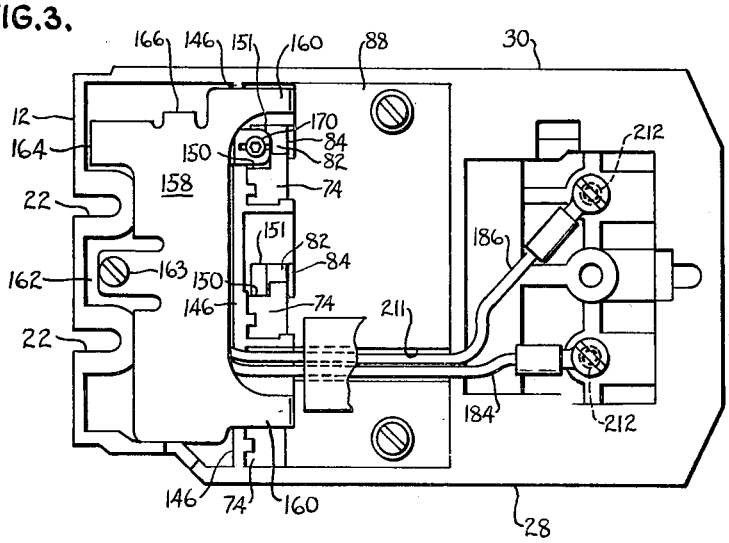
FIG. 3 is a rear plan view of the switch in FIG. 1.

The overload portion 26 of the base 12 has a pair of partitions 62 spaced between the walls 28 and 30 to divide the overload portion 26 into three compartments 64, 65 and 66. Positioned in the respective compartments 64–66 are melting alloy-type current responsive means or overload elements 68. The overload elements in compartments 65 and 66 in FIG. 2 are omitted to illustrate other portions of the switch 10. As shown in FIG. 2, the overload elements 68 are secured to the respective conductive straps 56 by screws 70. Each overload element 68 includes a solder-type current responsive unit which has a heater element connected in series with a circuit to be monitored. A typical example of an overload element is disclosed in the Van Valkenburg U.S. Pat. No. 1,752,514, issued Apr. 1, 1930. When the current flowing through the monitored circuit and therefore the heating element of the overload element exceeds a predetermined value, the solder within the unit melts and permits a ratchet wheel 72 of the overload element ot rotate. Normally the solder of the overload elements 68 is in a solid state and surrounds the shaft whereon the ratchet wheels 72 are fixed to hold the ratchet wheels 72 against rotation. When any one or all of the overload elements 68 are subjected to abnormal current flow, the ratchet wheels 72 of the overheated overload elements 68 will be free to rotate. After the abnormal current flow ceases, the solder again solidifies to maintain the racthet wheels 72 against rotation.

Extending into each of the respective compartments 64–66 from the rear wall 20 is a guideway for a slider 74. The respective sliders 74 in each compartment 64-66 has a latch portion 76 that is engageable with the teeth on the ratchet wheels 72, a portion that provides a seat for one end of a spring indicated by a numeral 78 in FIG. 1, and a projection 80 that is engaged by an arm portion 82 on a lever 84. The lever 84 has a portion 86 pivotally mounted between portions of the base 12 and a cover 88 which also provides a seat for the springs 78. A slider 90 which is movable in a suitable groove in the material of the base 12 has an end 92 engaging a portion of the lever located between the pivot 86 and the arm portions 82 that rest on the projection 80.

When the overload elements 68 are in a reset condition, that is, when the ratchet wheels 72 are held immovable by the solidified solder within the overload elements 68, the latch portion 76 on the respective sliders 74 will engage the teeth of the ratchet wheels 72 and maintain the sliders 74 in a position wherein the springs 78 are compressed. The lever 84 will be positioned adjacent the rear wall 20. In the event that any of the overload elements 68 in the compartments 64-66 are subjected to an excess current, the ratchet wheels 72 of the overheated overload element 68 will be free to rotate so that the springs 78 will cause the slider 74 in the compartment containing the overheated overload element 68 to move in a direction which will cause the lever 84 to rotate in a clockwise direction, as in FIG. 1. The clockwise direction of the lever 84 causes the slider 90 to move forwardly in a direction which will cause the trip mechanism within the housing 14 to move to a tripped position, as will be hereinafter described.

The housing 14 is provided with a pair of spaced grooves along its opposite side walls that extend perpendicular to the rear wall which act as guideways for a movable contact carrier 94 and guide the movement of the carrier 94 along an axis extending in a plane normal to the rear wall 20 through the center line 46. The contact carrier 94 has an end that is notched to provide three spaced projections that respectively extend into the arc chambers 36, 38 and 40 and are provided with openings wherein a movable contact 96 and a spring 98 are positioned. The movable contacts 96 are positioned by the carrier 94 to engage and bridge the stationary contacts 48 and 50 when the carrier 94 is moved toward the rear wall 20 to an actuated position by the toggle mechanism 16. The notches which define the central projection and straddle the partitions 33 and 34 are arranged so portions of the projections on the carrier 94 are guided by the edges on the partitions 33 and 34 to guide the movement of the carrier 94 relative to the base 12. The carrier 94 also has an actuating portion 99 that is centrally located on an end of the carrier remote from the projections carrying the movable contacts 96. The portion 99 is engaged by a portion 101 on a lever 100 of the toggle mechanism 16.

As shown in FIGS. 4-9, the toggle mechanism 16 includes the toggle lever 100, an operating lever 102, a trip lever 104, a toggle spring 106, a trip lever spring 108, a toggle latch lever 110, a latch lever spring 112, a trip lever latch 114 and a means for moving the operating lever 102 which, in the embodiment shown, includes an OFF-RESET button 116 and an ON button 118. The housing 14 provides a support for a main pivot 120 for the toggle mechanism.

Figure 6:
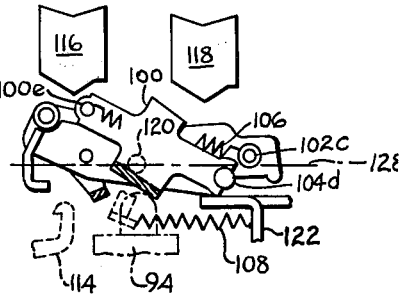
Figure 8:
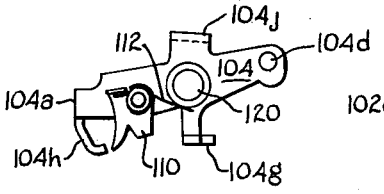
FIG. 8 is an elevational view of the trip lever for the toggle mechanism as shown in FIGS. 4–6.
Figure 7:
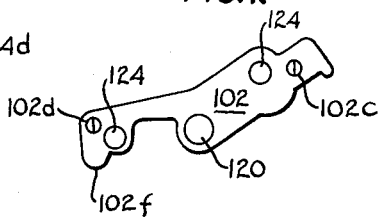
FIG. 7 is an elevational view of an operating lever for the toggle mechanism as shown in FIGS. 4–6.
Figure 9:
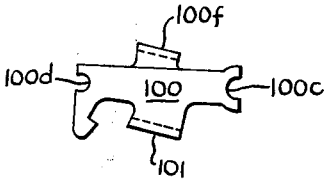
FIG. 9 is an elevational view of the toggle lever for the toggle mechanism as shown in FIGS. 4–6.

The operating lever 102 shown in FIG. 7 is formed of two identical members which are maintained in parallel spaced relation to each other by a pair of pins **102*c* and 102*d*. The pivot 120 is provided by a pair of pins, each of which is supported by portions of the housing 14. The trip lever 104 is formed as a U-shaped part to have a bight portion 104*a* and a pair of parallel members extending within the space between the members on the operating lever 102. A pair of pins provide the pivot 120 with each pin secured to one of the members forming the trip lever 104 and extending through an opening in the members forming the operating lever 102 to pivotally mount the operating lever 102 and the trip lever 104 on the pivot 120. The pivot 120 has an axis extending in the plane of movement of the carrier 98. The levers 102 and 104 are pivoted on the pivot 120 so that the levers 102 and 104 effectively have arm portions extending in opposite directions from the pivot 120 with the pin 102*c* on one end of the lever 102 located on the right side of the pivot 120. Similarly, the arm portions of the lever 104 locate the bight portion 104*a* on the left side of the pivot 120 and an auxiliary pivot 104*d* on the right side of the pivot 120. The toggle lever 100 includes a pair of members that extend parallel to and are received within the space between members forming the trip lever 104. The members forming the toggle lever 100 are interconnected by the actuating portion 101 that is located between the opposite ends and along the rear edges of the members forming the toggle lever 100 so as to constantly engage the actuating portion 99 of the carrier 94. The members which provide portions of the toggle lever 100 have their opposite ends notched so that a notch 100*c* on an end of an arm portion located at the right of the pivot 120 is pivotally mounted on the pins providing the auxiliary pivot 104*d* on the lever 104 and a notch 100*d* on an end of an arm portion extending to the left of the pivot 120 carries a pin 100*e*. The toggle spring 106 has its opposite ends respectively connected to the pin 100*e* and the pin 102*c*. The trip lever 104 is provided with an extension 104g whereon one end of the trip lever spring 108 is seated. The other end of the spring 108 is seated on a stop member 122, carried by the housing 14. The spring 108 constantly urges the trip lever 104 in a clockwise direction of rotation in FIGS. 4–6. The bight portion 104*a* extends to a hook 104*h* that is engaged by a hook portion 114*a* on the trip lever latch 114 that is rotatably carried by the housing 14 and biased by a spring, not shown, to rotate the latch 114 in a clockwise direction in FIGS. 4–6. The buttons 116 and 118 are each guided for movement by the material of the housing 14 and are provided with suitable slots, not shown, which receive pins 124 on the lever 102 so that the buttons 116 and 118 when moved toward the rear wall 20 will cause the lever 102 to rotate about the pivot 120. In this connection it is apparent that instead of using the buttons 116 and 118 to operate the lever 102, a single lever projecting forwardly of the lever 102 through an elongated opening in the forward end of the housing 14 may be used to rotate the lever 102 about the pivot 120**.

As disclosed in the Puetz patent, if desired, switches, not shown, may be installed in either or both compartments 42 and 44 which may impose an unbalanced load on the carrier 94 and cause the carrier 94 to tilt during its movements. The tilting of the carrier 94 is eliminated by the stabilizing bar 126 which has a pair of arm portions extending through notches in the opposite ends of the carrier 94. The stabilizing bar 126 is formed as a U-shaped member to have a bight portion pivotally mounted on the housing 14 and the pair of arms extending from the bight portion through the notches and in the carrier 94 to present a free end on each of the arms. A pair of springs, not shown, each have an end bearing against one of the ends on the free ends of the arms and portions of the base 12 to constantly urge the stabilizing bar 126 and the contact carrier 94 to a position wherein the movable contacts 96 are separated from the stationary contacts 48 and 50. When the contact carrier 94 is moved downwardly by the toggle mechanism 16, in a manner as will be hereinafter described, the stabilizing bar 126 rotates about its bight portion as the arm portions prevent the contact carrier 94 from tilting when an unequal load is applied to the respective ends of the carrier 94.

The operation of the toggle mechanism 16 is as follows. The levers of the toggle mechanism 16 are shown in the OFF- RESET condition in FIG. 5, wherein engagement between the hooks **104*h* and 114*a* causes the spring 108 to be compressed and maintain the trip lever 104 against a clockwise rotation and positions the lever 104 so that the auxiliary pivot 104*d* is located above a center line indicated by a broken line 128 which extends through a pivot 120. The OFF-RESET button 116, which has been previously depressed, positions the operating lever 102 so that the pivot pin 102*c* is located above the center line 128. The toggle spring 106 has its opposite ends connected between the pin 102*c* and the pin 100*e*. The position of the pin 102*c* above the center line 128 causes a line of centers between the pins 102*c* and 100*e* to be disposed above the center line 128 and the toggle spring 106 causes toggle lever 100 to be positioned on the auxiliary pivot 104*d* so that the pin 100*e* is above the center line 128 and the actuating portion 101 is positioned so that the movable contact carrier 94 is moved forwardly in the base by the springs to a position wherein the movable contacts 96 are separated from the stationary contacts 48 and 50. When the toggle mechanism 16 is in the OFF position, a stop 100*f* carried by the toggle lever 100 engages an upper edge of the trip lever 104 to prevent further movement of the toggle lever 100 and the operating lever 102 by the toggle spring 108**.

Figure 4:
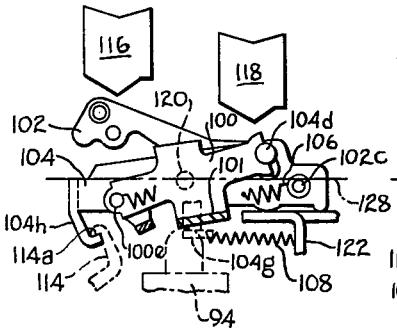
FIGS. 4, 5 and 6 are diagrammatic views of the toggle mechanism used in the switch in FIG. 1, respectively showing the position of the levers of the toggle mechanism when the levers are positioned in the ON, OFF and TRIPPED operating positions of the switch.
Figure 5:
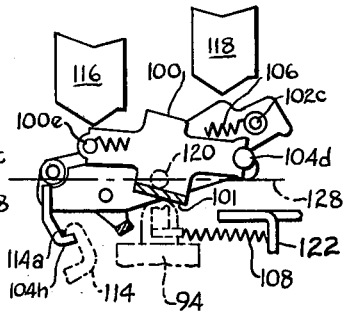

The toggle mechanism is moved from the OFF position shown in FIG. 5 to the ON position shown in FIG. 4 by depressing the operating button 118. The depression of the button 118 causes the operating lever 102 to rotate about the pivot 120 in a clockwise direction so that the pivot pin **102*c* is positioned beneath the center line 128 and causes the line of centers between the pin 102*c* and the pin 100*e* to be disposed beneath the center of the pivot 120 whereby the toggle spring 106 causes the toggle lever 100 to rotate about the auxiliary pivot 104***d* and position the pin 100*e* below the center line 128. The movement of the toggle lever 100 causes the actuating portion 101 to move toward the rear wall 20 so that the movable contact carrier 94 moves and causes the movable contacts 96 to engage the stationary contacts 46 and 48 with a firm engagement as the movable contacts 96 compress the movable contact springs 98. The movement of the levers of the toggle mechanism 16 when positioned in the ON position is limited by a stop 104*j* that is carried by the trip lever 104 as the stop 104*j* engages an upper surface portion on the toggle lever 100.

In the event of an excess current flow through any one or all of the overload elements 68 or a loss of volage at the line terminals 52, the levers of the toggle mechanism 16 will automatically move from the position shown in FIG. 4 to the tripped position shown in FIG. 6, as follows. When the toggle mechanism 16 is positioned in the ON position, the spring 108 will be compressed, pins 100*e* and 102*c* will be located below the center line 128, and the auxiliary pivot 104*d* will be positioned above the center line 128. The contact carrier 94 is positioned by the portion 101 so that the stationary contacts 48 and 50 are bridged by the movable contacts 96. An excess current through any one or all of the overload elements 68 will release at least one of the ratchet wheels 72, thereby releasing the latch portions 76 of at least one of the sliders 74 so that the released slider 74 is moved forwardly by a spring 78. The forward movement of the released slider 74 will cause the lever 84 to rotate about its pivot 86 and the slider 90 to move forwardly. The slider 90 has a portion engaging a portion of a lever which carries the trip lever latch 114 so that the forward motion of the slider 90 through a camming action causes the latch 114 to rotate clockwise and release the hook 104*h*. The release of the hook 104*h* permits the trip lever 104 to rotate in a clockwise direction to a tripped position wherein portions of the trip lever 104 engage the stop 122. During the rotation of the trip lever 104 to the tripped position, the auxiliary pivot 104*d* will pass through the line of centers between the pins 102*c* and 100*e* to a position below the center line between the pins 102*c* and 100*e*. The movement of the auxiliary pivot to the tripped position causes the toggle spring 106 to supply a force which rotates the toggle lever 100 in a clockwise direction and the operating lever 102 to rotate in a counterclockwise direction to a neutral position wherein the position of the operating lever 104 will cause the buttons 116 and 118 to be positioned so that their top surfaces are aligned in a single plane and visually indicate from the exterior of the switch 10 that the components of the switch 10 have responded to an overload condition. Also, when the toggle mechanism 16 is tripped, the portion 101 will be in a fully retracted position so that the contact carrier 94 is moved upwardly by its associated springs to a position whereat the movable contacts 96 are separated from the stationary contacts 48 and 50.

After the switch 10 has responded to an overload current condition, the components of the switch may be restored to the OFF-RESET position as follows. As previously indicated, the switch 10 will respond to an overload current condition and cause the buttons 116 and 118 to be aligned. The depression of the OFF-RESET button 116 from its aligned position with the button 118 will cause the operating lever 102 to rotate in a counterclockwise direction and cause the pin 102*d* to engage the upper surface of the trip lever 104 and move the trip lever 104 in a counterclockwise direction to the RESET position. the lever 102 has portions 102*f* which are arranged to engage portions on the slider 90 and move the slider 90 toward the rear wall 20 when the lever 102 rotates in a counterclockwise direction. The portion 92 on the slider 90 will thus cause the lever 84 to rotate counterclockwise and the sliders 74 to move toward the rear wall to a position wherein the latch portions 76 are positioned to engage the teeth of the ratchet wheels 72. In the event the solder in all of the overload elements 68 has been solidified, so that the ratchet wheels 72 will no longer be free to rotate, the lever 84 will be maintained in its position adjacent the rear wall so that a spring, not shown, will move the lever carrying the hook 114 to a position which will permit the hook 114 to engage the hook 104*h* and maintain the trip lever 104 in the reset position, as previously described. In event the ratchet wheels are not held fixed, as may be caused when the device is prematurely reset, the release of the operating OFF-RESET button 116 will cause the sliders 74 to move the lever 84 and the slider 90, as previously described. Thus the switch 10 will have a trip-free operation.

A mechanism 140 which causes the levers of the toggle mechanism 16 to move to the tripped position and the contacts of the switch 10 to open in the event of a power failure of the source connected to the switch 10 is enclosed within a cavity 142 in the base 12. The cavity 142 extends between the side walls 28 and 30 from the rear wall 20 and has a wall 146 at its upper end. The wall 146 extends between the side walls 28 and 30 and has surface portions facing the upper end of the switch 10 providing guide surfaces for the sliders 74 and includes a notch 150 that is aligned with a portion 151 on the lever 84.

Figure 10:
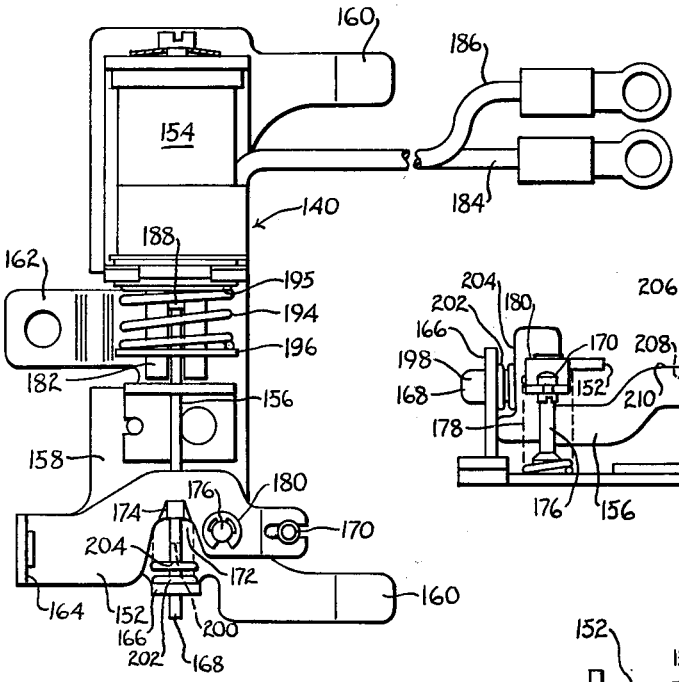
FIG. 10 is a front plan view of the mechanism included in the switch in FIG. 1 for causing the switch to open in the event of a power failure of the source connected to the switch.
Figure 11:
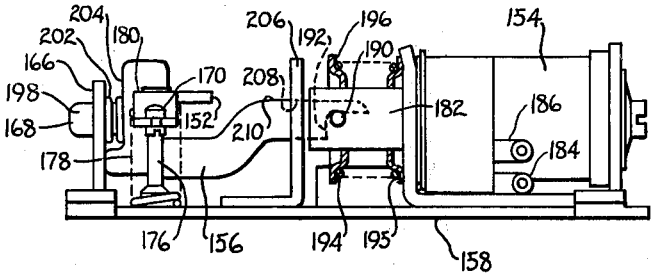
FIG. 11 is a side view of the mechanism in FIG. 10.
Figure 12:
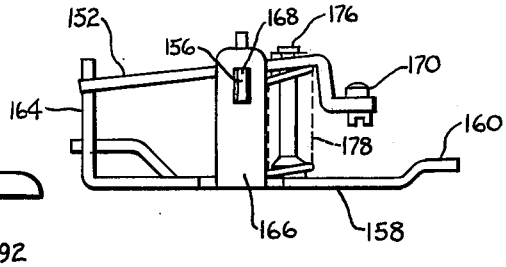
FIG. 12 is an end view of the mechanism in FIG. 10.
Figure 13:
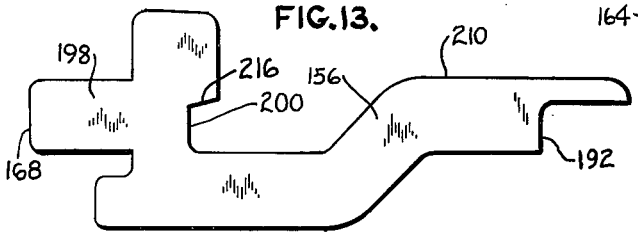
FIG. 13 is an elevational view of a latch lever used in the mechanism shown in FIG. 10.

As shown in FIGS. 10–12, the mechanism 140 includes a spring biased lever 152, a solenoid 154 and a latch 156 carried on a base 158. The base 158 positions the mechanism 140 within the cavity 142 and has a pair of ears 160 received beneath the cover 88 and an apertured ear 162 receiving the screw 163 that is tightened into an embedded threaded insert, not shown, in the base 12. The base 158 also has a forwardly extending ear 164 that provides a pivot at its free end for the lever 152 and a forwardly extending ear 166 that provides a guide for a free end 168 of the latch 156. The lever 152 is formed as a stamped metal part and has one end pivoted on the ear 164 through a suitable notched connection and an adjustment screw 170 at its opposite end. The lever 152 also has a notch 172 formed intermediate its ends that extends from a side edge of a lever 152 and an inclined surface 174 formed at the root of the notch 172. The lever 152 additionally has an opening located intermediate the notch 172 and the screw 170 which receives a free end on a pin 176 that serves as a guide for the movement of the lever 152. The pin 176 is surrouned by a spring 178 that is positioned between the base 158 and the lever 152 and constantly urges the lever into engagement with a retaining ring 180. The ring 180 has a portion received in a suitable groove in the pin 176 to act as a stop to limit the movement of the lever 152 in response to the bias force exerted by the spring 178.

A plunger 182 of the solenoid 154 is connected to the latch 156 through a lost motion connection which permits the plunger 182 to move to the right in FIG. 11 independently of the latch 156 when a pair of leads 184 and 186 are energized. The latch 156 is positioned in a slot 188 in the free end of the plunger 182 by a pin 190. The pin 190 is engageable with a shoulder 192 on the latch 156 so that the plunger 182 may move to its energized position independently of the latch 156 and move the latch 156 to its released position when the plunger 182 moves to its de-energized position. The plunger 182 is constantly urged to its de-energized position by a compression spring 194 that has one end resting on the spring seat 195 abutting the front end of the solenoid 154 and a spring seat 196 which is maintained in its engagement with the spring 194 by the pin 190.

The latch 156 is formed as a stamped metal part to have the shoulder 192 at one end and an ear 198 extending through a suitable opening in the ear 166 at its end 168. A portion of the latch 156 intermediate the shoulder 192 and the ear 198 includes a notch 200 which is received in the notch 172 and arranged to engage the inclined surface 174 to maintain the spring biased lever 152 at its reset or inactive position against the force exerted by the spring 178 when the solenoid 154 is energized and the latch 156 is moved to a latching position. The latch 156 is constantly urged to the latching position by a spring 202 that is positioned between the ear 168 and an abutment surface 204 on the latch 156 so that when the solenoid 154 is energized and the lever 152 is moved to the reset or inactive position, the spring 202 will move the latch 156 to a position where the notch 200 receives the inclined surface 174 to maintain the lever 152 at its reset position. The mechanism 140 also includes a guide that is secured to the base 158 to present a notch having an edge 208 that is engaged by upper edge portions 210 on the latch 156 to assure that the plunger 182 is properly centered in the bore in the solenoid 154 and may move without a binding action to its energized and de-energized positions.

As previously described, the mechanism 140 is positioned within the cavity 142 when the base 158 is positioned and secured to the rear wall of the switch 10 by the ears 160 and the ear 162 after the screw 163 is tightened into the insert in the base of the switch 10. When the mechanism 140 is positioned in the cavity, the leads 184 and 186 will extend through a suitably located groove 211 in the rear side of the cover 88 and have their terminal ends electrically connected to inserts 212 associated with arc chambers 36 and 40. The inserts 212 threadedly receive the screws 214, securing the terminal members 52 to the stationary contacts 50 in the arc chambers 36 and 40, so that when the switch 10 is connected to a voltage source via the terminal members 52, the solenoid 154 will be continuously energized as long as the source connected to the switch is energized. The mechanism 140 when positioned in the cavity 142 will have a portion of the lever 152 extending through the notch 150 and locate the screw 170 so it is engageable with the portion 151 on the lever 84. The screw 170 is located on the end of the lever 152 and is adjustable to compensate for manufacturing tolerances and coordinate the movement of the lever 152 with the movement of the portion 151 to cause the toggle mechanism 16 of the switch to move to a tripped position upon loss of power connected to the terminals 52.

The components of the low voltage release mechanism 140 are moved to their respective reset positions when the solenoid 154 is energized in response to a voltage supplied through the leads 184 and 186 at the terminals 52. The energized solenoid 154 causes the plunger 182 to move to its energized position independently of the latch 156 as the pin 190 moves out of engagement with the shoulder 192. The energization of the solenoid 154 additionally causes the spring 194 to be compressed. The lever 152 and the latch 156, when in the tripped position, are positioned so that the lever 152 is positioned by the spring 178 to engage the retaining ring 180. The lever 152 when thus positioned will have the leading edge of the inclined surface 174 aligned with a surface 216 located on the latch 156 adjacent the notch 200 and prevent the spring 202 from moving the latch to its latching position. The lever 152 is moved to its reset position when a suitable force on the button 116 causes portion 151 on the lever 84 to move the lever 152 against the bias provided by the spring 178 to a position where the notched inclined surface 174 is aligned with the notch 200. When the lever 152 is thus positioned, the spring 202 causes the latch 156 to move toward the plunger 182 to its latching position where the inclined surface 174 is positioned within the notch 200 to maintain the lever at its reset position when the force on the button 116 is released.

In the event the power to the switch 10 is interrupted while the switch is in the ON position and the sliders 74, as well as the lever 152, are in their respective reset positions, the following will occur. When the switch 10 is in the ON position, the levers of the toggle mechanism 16 will be positioned as shown in FIG. 4. As previously described, the engagement between the hook **104*h* and the trip lever latch 114 prevents the trip lever 104 from moving to the tripped position shown in FIG. 6. Loss of power to the switch 10 will cause the solenoid 154 to be de-energized and permit the spring 194 to move the plunger 182 to its released position. The movement of the plunger 182 to the released position through the engagement provided by the pin 190 and the shoulder 192 causes the latch 156 to move to its released position as the force exerted by the spring 194 greatly exceeds the force exerted by the spring 202. The movement of the latch 156 to its released position causes the notch 200 to move out of its engagement with the inclined surface 174 and permits the spring 178 to move the lever 152 to its tripped position where it engages retaining ring 180. The movement of the lever 152 to its tripped position through the engagement provided by the screw 170 and the portion 151 causes the lever 84 to rotate about its pivot 86 and the slider 90 to move forwardly. As previously described, the slider 90 has a portion engaging a portion on a lever which carries a trip lever latch 114 so that the forward motion of the slider 90 through a camming action causes the latch 114 to rotate clockwise and release the hook 104*h*. The released hook 104*h* permits the trip lever 104 to rotate in a clockwise direction to its tripped position wherein portions of the trip lever 104 engage the stop 122. During the rotation of the trip lever 104 to the tripped position, the auxiliary pivot 104*d* will pass through the line of centers between the pins 102*c* and 100*e* to a position below the center line between the pins 102*c* and 100*e*. The movement of the auxiliary pivot to the tripped position causes the toggle spring 106 to supply a force which rotates the toggle lever 100 in a clockwise direction and the operating lever 102 to rotate in a counterclockwise direction to a neutral position whereat the position of the operating lever 104 will cause the buttons 116 and 118 to be positioned so that their top surfaces are aligned in a single plane to visually indicate from the exterior of the switch that the components of the switch have responded to a loss-of-voltage condition. Also, when the toggle mechanism 16 is in a tripped condition, the portion 101 will be fully retracted so that the contact carrier 94 is moved upwardly by its associated springs to a position whereat the movable contacts are separated from the stationary contacts 48 and 50**.

After the switch 10 has responded to power failure conditions and the power is restored, the components of the switch 10 may be restored to the OFF-RESET position as follows. As previously indicated, the response of the switch 10 to an overload current condition or a power loss condition causes the buttons 116 and 118 to be aligned. The depression of the OFF-RESET button 116 from its aligned position with the button 118 will cause the operating lever 102 to rotate in a counterclockwise direction and cause the pin 102*d* to engage the upper surface of the trip lever 104 to move the trip lever 104 in a counterclockwise direction to its OFF-RESET position. The lever 102 has portions 102*f* which are arranged to engage portions on the slider 90 and move the slider 90 toward the rear wall 20 as the lever 102 rotates in a counterclockwise direction. The movement of slider 90 toward the rear wall 20 through the portion 92 on the slider causes the lever 84 to rotate counterclockwise and the engagement of the portion 151 on lever 84 and the screw 170 causes the lever 152 to move to its reset position. In event power is restored to energize the solenoid 154, the lever 152 is maintained at its reset position by the latch 156 after the latch 156 moves to its latching position as previously described. In the event that power to the swtich 10 is not restored and an attempt is made to reset the switch, the solenoid 154 will remain de-energized and the plunger 182 and spring 194 will position the latch 156 at its released position and prevent the engagement between notch 200 and the inclined surface 174.

As previously described, when the levers of the toggle mechanism are moved to the OFF-RESET position shown in FIG. 5, lever 102 has portions which engage portions on the slider 90 and move the slider 90 toward the rear wall as the lever 102 rotates in a counterclockwise direction. When the levers of the toggle mechanism are in the full OFF-RESET position, the toggle spring 106 will supply a force which maintains the levers in their OFF-RESET position and the lever 84 to be maintained in its furthest counterclockwise position wherein the engagement between the portion 151 and the screw 170 causes the lever 152 to be maintained at its reset position independently of the latching action provided by the latch 156. When the toggle mechanism is in the OFF-RESET position, the force of the toggle spring 106 will exceed the force supplied by the spring 178 on the lever 152 and the levers of the switch will remain at their respective OFF-RESET positions. Thus, when the levers are in the OFF-RESET position, which may occur at the end of the work shift, and the power to the switch 10 is interrupted and reestablished while the switch is in the OFF state, it is not necessary to reset the switch before the switch is turned to the ON position. However, when the toggle mechanism 16 levers are in the OFF-RESET position and the power to the switch is interrupted so that the solenoid 154 is de-energized, in the event an attempt is made to turn the switch to the ON position, movement of the lever 102 will cause the portion 102*f* to move and remove the force supplied by the toggle spring 106 which maintained the slider 90 and the lever 84 at their respective RESET positions. Thus, as the levers of the toggle mechanism 16 move toward their respective ON positions, the lever 152 moves and causes the lever 84 and the slider 90 to move toward their respective tripped positions to release the engagement between the hooks 114*a* and 104*h* to trip the toggle mechanism 16 in the manner heretofore described.

While certain preferred embodiments of the invention have been specifically disclosed, it is understood that the invention is not limited thereto, as many variations will be readily apparent to those skilled in the art and the invention is to be given its broadest possible interpretation within the terms of the following claims.

What is claimed is:

1. In an electric switch, the combination comprising: an insulating base having a rear wall, a cavity extending forwardly in the rear wall, a plurality of pairs of spaced stationary contacts mounted on a front wall of the base with one of the contacts of each pair connected through a terminal member to a voltage source, a movable contact assembly including a movable contact carrier and a plurality of movable contacts positioned by the carrier so each of the movable contacts bridgedly engages a pair of stationary contacts when the carrier is at an actuated position and is separated from the stationary contacts when the carrier is at a de-activated position, a toggle mechanism including an operating lever, a toggle lever and a trip lever pivotally mounted so the carrier is moved by the toggle lever to its actuated position when the trip lever is at a RESET position and the operating lever is moved from an OFF position to an ON position and the carrier moves to its de-activated position when the trip lever is at a tripped position, a spring constantly biasing the trip lever toward its tripped position and means including a releasable latch for releasably maintaining the trip lever against the bias of said spring at the reset position, and means including a solenoid, a spring biased lever, and a latch member positioned within the cavity for causing the latch to release the trip lever and the carrier to move to the de-activated position in event of power failure of the source.

2. The electric switch as recited in claim 1 wherein the solenoid has a winding connected to a pair of the terminal members for being energized by the source and a connection with the latch member for maintaining the spring biased lever in an inactive position when the solenoid is energized and for moving the latch member to an inactive position for causing the releasable latch to move and release the trip lever to movement to the tripped position in event of a power failure of the source.

3. The electric switch as recited in claim 2 including means responsive to current in a circuit including the stationary contacts for causing the releasable latch to move and release the trip lever when the current in the circuit exceeds a predetermined value.

4. In an electric switch, the combination comprising: an insulating base having a rear wall, a cavity extending forwardly in the rear wall, a plurality of pairs of stationary contacts mounted on a front wall of the base with one of the contacts of each pair connected through a terminal member on the base to a voltage source, a movable contact assembly including a movable contact carrier and a plurality of movable contacts positioned by the carrier so each of the movable contacts bridgedly engages a pair of stationary contacts when the carrier is at an actuated position and is separated from the stationary contacts when the carrier is at a de-activated position, a toggle mechanism including a toggle lever, an operating lever and a trip lever pivotally mounted so the carrier is engaged and moved by the toggle lever to its actuated position when the trip lever is at a RESET position and the operating lever is moved from an OFF position to an ON position and the carrier moves to its deactivated position when the trip lever is at a tripped position, said operating lever and trip lever having inter-engaging portions for causing the trip lever to be moved from the tripped position to the RESSET position as the operating lever is moved to the OFF position, a spring constantly biasing the trip lever toward its tripped position and means for releasably maintaining the trip lever against the bias of the spring at the RESET position when the trip lever is moved by the operating lever to the RESET position, said means for releasably maintaining the trip lever at the RESET position including: a rotatable lever having a first portion engaging a portion on the trip lever for maintaining the trip lever at the RESET position when the rotatable lever is at a RESET position, a linearly movable slider having a first end engaging and a second portion on the rotatable lever for moving the rotatable lever to a tripped position whereat the first portion is disengaged from the engaging portion on the trip lever when the slider is moved to a tripped position and portions on the first end of the slider engageable by portions on the operating lever for moving the slider from the tripped position to a RESET position when the operating lever is moved to the OFF position, a pivotal lever having a portion engaging a second end of the slider for moving the slider to the tripped position when the pivotal lever is moved to a tripped position and moved by the slider to a RESET position when the slider is moved to the RESET position, and means including a solenoid, a spring biased lever and a latch member positioned within the cavity for causing the pivotal lever to move to the tripped position in event of power failure of the source.

5. The electric switch as recited in claim 4 including means responsive to current in a circuit including the stationary contacts for causing the pivotal lever to move to the tripped position when the current in the circuit exceeds a predetermined value.

6. The electric switch as recited in claim 4 wherein the solenoid has a winding connected to a pair of the terminal members for being energized by the source and includes a plunger having a connection with the latch member for maintaining the spring biased lever in an inactive position when the solenoid is energized and for moving the latch member to an inactive position for causing the releasable latch to move and release the trip lever for movement to the tripped position in event of a power failure of the source.

7. The electric switch as recited in claim 6 wherein the operating lever when in the OFF position causes the trip lever, the rotatable lever, the slider, the pivotal lever and the latch member to be at their respective reset positions when power from the source to the solenoid is interrupted.

8. The electric switch as recited in claim 2 wherein the latch member is constantly biased toward a latching engagement with the spring biased lever by a spring and the connection between the latch member and a plunger of the solenoid permits the plunger to move to an activated position when the solenoid is energized and the latch member is at its inactive position.

9. The electric switch as recited in claim 6 wherein the spring biased lever has a first end pivoted on a stationary support, a second end engaging a portion of the pivotal lever, a portion intermediate its ends engaged by a notched portion on the latch member when the solenoid is energized and including a spring engaging the portion between the ends for constantly urging the second end into engagement with the pivotal lever.

10. The electric switch as recited in claim 9 wherein the latch member is constantly biased toward a latching engagement with the spring biased lever by a spring and the connection between the latch member and the plunger of the solenoid permits the plunger to move to an activated position when the solenoid is energized and the latch member is at its inactive position.

* * * * *

UNITED STATES PATENT AND TRADEMARK OFFICE

CERTIFICATE OF CORRECTION

PATENT NO. : 4,068,201

DATED : January 10, 1978

INVENTOR(S) : Walter C. Karch and Joseph J. Gribble

It is certified that error appears in the above-identified patent and that said Letters Patent are hereby corrected as shown below:

Col. 4, line 11, "ot" should read --to--.
Col. 4, line 19, "racthet" should read --ratchet--.
Col. 7, line 16, "volage" should read --voltage--.
Col. 8, line 53, delete "and" and insert --to--.
Col. 8, line 58, "surrouned" should read --surrounded--.
Col. 12, line 48, "to" (first occurrence) should read --for--.
Col. 13, line 9, "RESSET" should read --RESET--.
Col. 13, line 21, delete "and" after the word --engaging--.

Signed and Sealed this

*Seventh* Day of *November 1978*

[SEAL]

*Attest:*

RUTH C. MASON
*Attesting Officer*

DONALD W. BANNER
*Commissioner of Patents and Trademarks*